US005203825A

United States Patent [19]

Haynes et al.

[11] Patent Number: 5,203,825

[45] Date of Patent: Apr. 20, 1993

[54] CAPILLARY TUBE ASSEMBLY INCLUDING A VENTED CAP

[75] Inventors: John L. Haynes, Chapel Hill, N.C.; Stephen C. Wardlaw, Old Saybrook, Conn.; Edward Williamson, Dover, N.J.

[73] Assignee: Becton, Dickinson and Company, Franklin Lakes, N.J.

[21] Appl. No.: 711,844

[22] Filed: Jun. 7, 1991

[51] Int. Cl.[5] ..... B01L 3/02

[52] U.S. Cl. ..... 73/864.02

[58] Field of Search ..... 137/151; 138/89; 215/366, 367, 373; 604/256; 73/864.91, 864.51, 864.02; 422/100

[56] References Cited

U.S. PATENT DOCUMENTS

| | | | |
|---|---|---|---|
| 2,649,245 | 8/1953 | Silverstolpe . | |
| 3,164,279 | 1/1965 | Towns . | |
| 3,834,571 | 9/1974 | Bartell | 215/256 |
| 3,901,402 | 8/1975 | Ayres | 215/307 |
| 3,948,261 | 4/1976 | Steiner | 215/307 |
| 4,049,152 | 9/1977 | Treanor | 220/367 |
| 4,076,142 | 2/1978 | Naz | 215/307 |
| 4,175,671 | 11/1979 | Holl et al. | 220/367 |
| 4,192,429 | 3/1980 | Yerman | 215/307 |
| 4,204,606 | 5/1980 | Micheli | 215/307 |
| 4,411,163 | 10/1983 | White | 73/864.02 |
| 4,576,595 | 3/1986 | Aas et al. | 215/307 |
| 4,589,421 | 5/1986 | Ullman | 128/763 |
| 4,799,598 | 1/1989 | McFadyen | 220/366 |
| 4,883,641 | 11/1989 | Wicks et al. | 220/366 |

OTHER PUBLICATIONS

Wardlaw et al., "Quantitative Buffy Coat Analysis: A New Laboratory Tool Functioning as a Screening Complete Blood Cell Count", Journal of the American Medical Association, Feb. 4, 1983, vol. 249.

Brochure by Monsanto, "Santoprene: Thermoplastic Rubber", 1989.

Data Sheet produced by General Electric Co., 1985.

*Primary Examiner*—Robert Raevis

*Assistant Examiner*—N. Ashraf

*Attorney, Agent, or Firm*—Alan W. Fiedler; Royal N. Ronning, Jr.; Richard E. Brown

[57] ABSTRACT

A vented cap and capillary tube assembly is disclosed together with a method of use of such assembly. The assembly includes a capillary tube having a bore extending therethrough and a cap slidably mounted to one end of the tube. The cap includes one or more vent grooves therein which allow air to escape therethrough when the cap is in a first slidable position. The walls of the capillary tube prevent air from escaping through the vent when the cap is more fully inserted within the tube. The method provided herein includes the steps of providing such a pre-assembled capillary tube and vented cap assembly, maintaining the cap in the first position while the opposite end of the capillary tube is inserted within a liquid sample, allowing the liquid to enter the tube through capillary action, thereby displacing air within the tube through the vent, and sliding the cap to the fully inserted position, thereby sealing the vent. The cap used in conjunction with the capillary tube is made of an elastomeric material, and has a slippery surface. It includes an enlarged head having a cylindrical plug extending therefrom. The plug includes a sealing ring for engaging the inner wall of the capillary tube. It also includes an annular groove adjacent the enlarged head which facilitates the seating of the head on the end of the capillary tube.

15 Claims, 3 Drawing Sheets

CAPILLARY TUBE ASSEMBLY INCLUDING A VENTED CAP

BACKGROUND OF THE INVENTION

The field of the invention relates to closures for capillary tubes and their assembly to such tubes.

Capillary tubes are small tubes designed for drawing liquid by means of capillary action and retaining such liquid through surface tension and adhesion. They are commonly used for drawing samples of blood, chemical solutions and suspensions, and other such materials. For many applications, the tubes are about several inches in length, five millimeters or less in diameter, and have volumes from about ten to five hundred microliters.

Blood samples can be taken with a capillary tube by making a small puncture in a person's finger and then moving an end of the tube into contact with the drop of blood which forms upon the finger. The blood is drawn into the tube by capillary action. Alternatively, a blood sample can be taken with a syringe and later divided into smaller volumes for testing by inserting the end of one or more capillary tubes into the sample. For convenience, and if an exact metering of the sample is required, material may be directly aspirated into the capillary tube using a mechanical pipetter.

Certain tests require that a liquid sample within a capillary tube be centrifuged in order to determine the percentage of solids within the sample. Quantitative buffy coat analysis, for example, involves the use of a precision-bore glass capillary tube which contains a solid plastic float. Upon centrifugation, the plastic float floats on top of the red blood cells and expands the lengths of the buffy coat layers. Dyes which will later be taken up by specific nucleoproteins may be coated upon the capillary tube, thereby allowing the buffy coat layers to be distinguished.

One end of a capillary tube must, of course, be closed prior to mounting it within a centrifuge. Clay has been used to seal capillary tubes, but such seals require careful handling and do not provide a good interface with the sample to be analyzed. Since measuring the height of the liquid sample within the tube may be important, a sharp interface is desirable.

Plastic stoppers or caps are preferable to clay seals formed at the ends of capillary tubes from the standpoint of providing a sharp interface. However, they too must generally be applied after a sample has been taken. Great care must accordingly be exercised so that a large part of the sample is not lost. Application of the stopper may be difficult due to the small sizes of the stopper and capillary tube.

SUMMARY OF THE INVENTION

It is an object of the invention to provide a cap for a capillary tube which provides a clear interface between it and a liquid sample which may be within the tube.

It is another object of the invention to provide a cap which will allow a liquid to be drawn within a capillary tube by capillary action even while the cap is mounted to the tube.

It is another object of the invention to provide a vented cap for a capillary tube having a vented plug which is fully insertable within the tube.

A still further object of the invention is to provide a capillary tube and vented cap assembly which includes means for insuring that the vents are not inadvertently closed off.

A still further object of the invention is to provide a method for drawing a liquid sample into a capillary tube and sealing an end of the tube in a simple and reliable manner.

In accordance with these and other objects of the invention, a pre-assembled cap and tube assembly is provided which includes a capillary tube having a pair of open ends and a cap mounted to one of said ends, the cap including a vent for establishing fluid communication between the interior of the capillary tube and the atmosphere when in a first position with respect to the tube, the vent being closed by the tube when the cap is in a second position with respect thereto.

In a preferred embodiment of the invention, the cap includes at least one vent groove which adjoins a wall of the capillary tube. The groove includes an open end defined by an end surface of the cap and a closed end. The cap is movable between the first position where the walls of the capillary tube cover a portion of the groove, thereby allowing air from the tube to be vented therethrough, and the second position wherein the walls of the capillary tube cover the entire groove. Air can no longer be vented through the tube when the cap is in the second position, nor can liquid escape from the capped end of the tube at this time. The sample can accordingly be centrifuged or otherwise treated.

The cap preferably includes an enlarged head and a substantially cylindrical body or plug of reduced diameter. One or more substantially longitudinal vent grooves are provided within the cylindrical body. The cylindrical body also preferably includes a substantially annular groove adjacent to the enlarged head. The annular groove allows the resilient cap material to be displaced rearwardly during insertion without interfering with the seating of the enlarged head at the end of a tube or vial.

A sealing ring is also preferably defined by the cylindrical body. The vent grooves are preferably formed within both the cylindrical body and a portion of the sealing ring. This allows the bottom of the sealing ring to rest upon an end of a tube without closing the vent grooves.

In a method according to the invention, a pre-assembled cap and tube assembly is provided wherein the tube has a pair of open ends and the cap is mounted to one of the open ends. The cap includes a vent having an inlet portion and an outlet portion for allowing a fluid to pass from inside the tube to the atmosphere. The method includes the steps of inserting one end of the tube in a liquid while the cap is in a first position where the vent allows liquid to enter the tube via capillary action, and moving the cap to a second position where the vent inlet and/or outlet is covered by a wall of the tube, thereby preventing fluid from exiting the tube through the cap.

DETAILED DESCRIPTION OF THE INVENTION

A vented cap and a capillary tube assembly 10 as shown in FIGS. 1 and 2–5, respectively, are disclosed herein. The capillary tube 12 includes cylindrical walls made from a transparent material such as glass. One end of the tube is open; the other end includes a cap 14 mounted thereto. The tube 12 is constructed to draw a selected amount of liquid or a suspension therein via capillary action or by the application of negative pressure. The terms liquid and suspension shall be used interchangeably herein. The dimensions of the tube 12 may vary depending upon the properties of the liquid to be drawn therein.

Figure 1:
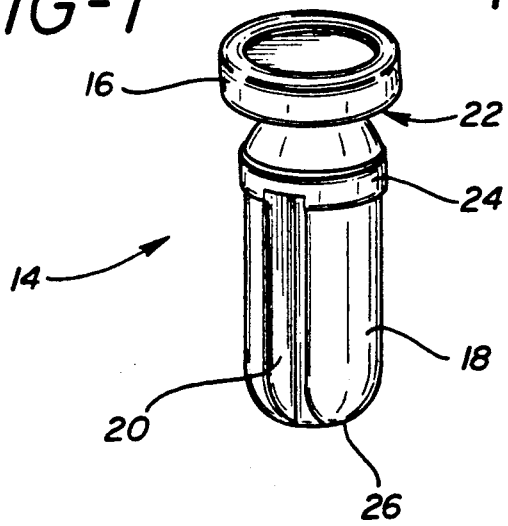
FIG. 1 is a top perspective view of a vented cap in accordance with the invention.

The cap 14 according to the invention is best shown in FIG. 1. It includes an enlarged head 16 and a substantially cylindrical body or plug 18 extending therefrom. The plug may have a maximum diameter of less than two millimeters if the cap is to be used for closing an end of a certain type of conventional glass capillary tube as used for blood sampling. Other diameters may alternatively be employed depending upon the diameter of the capillary tube to be used therewith. The cap is preferably of integral construction, and is made from a resilient, thermoplastic material such as SANTOPRENE® thermoplastic rubber, grade 201-73. This material is available from Monsanto Chemical Company of St. Louis, Mo. A colorant such as titanium dioxide may be mixed with the thermoplastic rubber prior to molding the cap so that a reflective and substantially opaque product is provided. The cap may be coated with a silicone oil such as dimethylpolysiloxane.

Two elongated grooves 20 are provided within the cylindrical plug 18. Each of the grooves runs substantially parallel to the longitudinal axis of the cylindrical plug. The grooves 20 are diametrically opposed to each other. Each includes an inlet portion adjacent to the bottom end of the plug 18.

An annular groove 22 is defined by the exterior surface of the cylindrical plug 18 where it adjoins the enlarged head 16 of the cap 14. A protruding ring 24, which is employed as a sealing ring for engaging the inner wall of the tube 12, is also defined by the plug 18. The elongate, longitudinal grooves 20 include outlet portions extending partially into the ring 24.

The end 26 of the plug 18 opposite from the enlarged head 16 is tapered to facilitate its insertion within a capillary tube or the like. The taper is defined by a spherical radius between the cylindrical body portion and an end surface of the plug.

Figure 2:
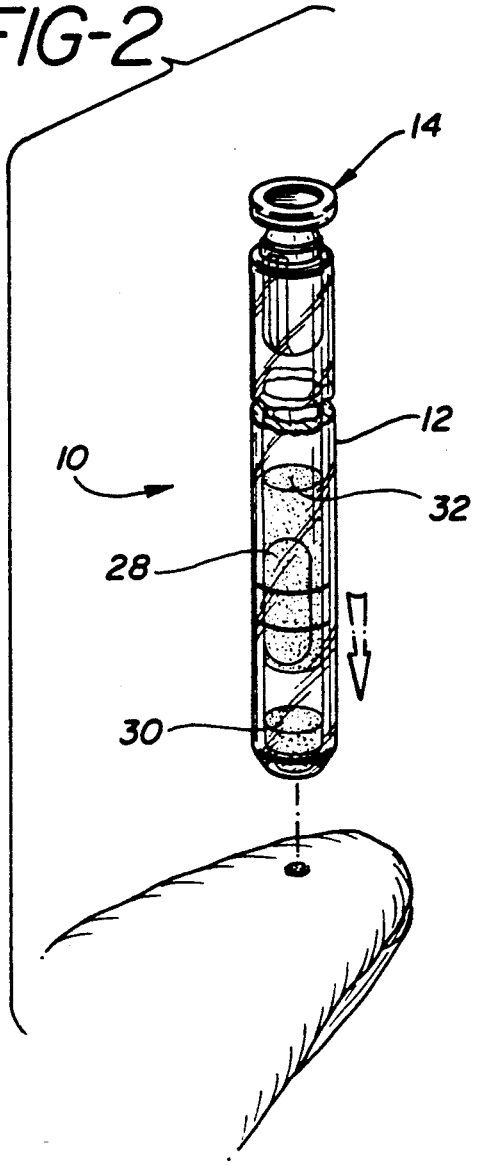
FIG. 2 is a top perspective view of a vented cap and capillary tube assembly positioned above a person's finger.
Figure 3:
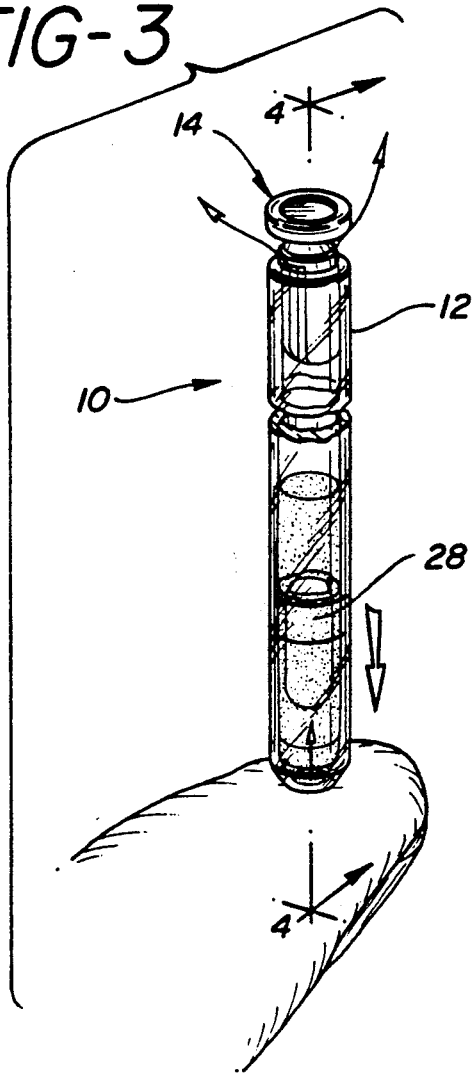
FIG. 3 is a top perspective view of the assembly shown in FIG. 2 in contact with the finger.
Figure 4:
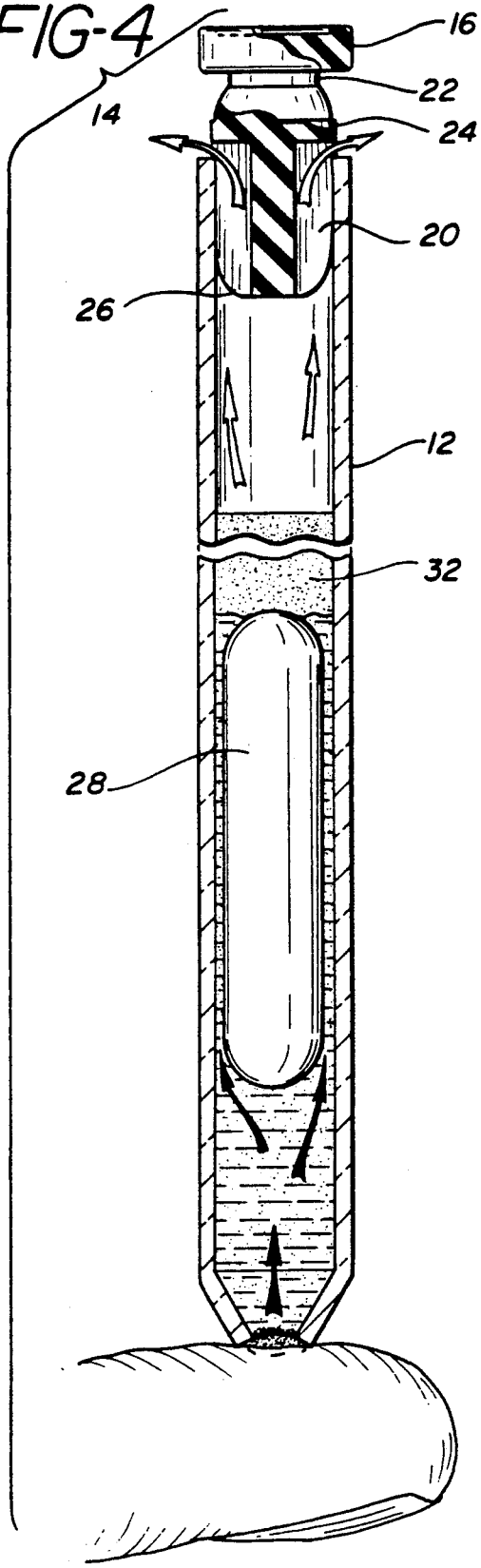
FIG. 4 is a sectional view taken along line 4—4 of FIG. 3.

As shown in FIGS. 2–3, the cap 14 and tube 12 are provided to the user as a pre-assembled construction which allows air to vent through the cap. Liquid is drawn into the tube with the cap in this position. The open end of the capillary tube is inserted within a liquid, as shown in FIGS. 3 and 4. Liquid is drawn within the tube via capillary action or via a mechanical pipetter. As the liquid approaches the cap 14, the displaced air within the tube moves through the vent grooves 22 and is vented to the atmosphere.

Figure 5:
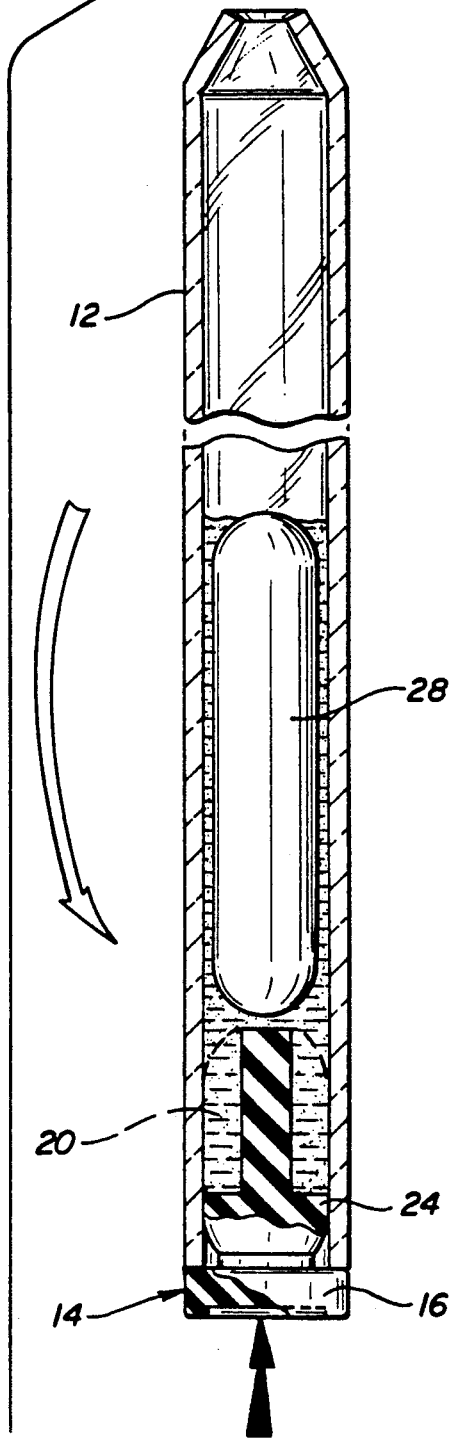
FIG. 5 is a sectional view of the assembly showing the vented cap in a fully inserted position within the capillary tube, the capillary tube being in an inverted position.

Once a sufficient amount of liquid has been drawn into the capillary tube 12, the cap 14 is moved to the position shown in FIG. 5. In this position, the outlet portion of each vent groove 20 is closed by the sealing engagement of the sealing ring 24 with the inner wall of the capillary tube 12. The lower surface of the enlarged head 16 of the cap 14 abuts against the end surface of the capillary tube, thereby providing an additional seal. The annular groove 22 allows the cap to be fully inserted despite the fact that the resilient material from which the cap is made tends to be displaced rearwardly during insertion. If a bulge were formed adjacent to the enlarged head 16 due to such displacement, it would engage the end of the tube and thereby prevent the enlarged head 16 from doing so.

The assembly 10 as shown in FIG. 5 may be mounted within a centrifuge, if the liquid is blood, to separate the blood components into discrete layers. Different procedures may, of course, be performed with blood or other liquid samples.

This assembly may be used to advantage in sampling and analyzing blood. It is particularly suitable for facilitating quantitative buffy coat (QBC) analysis and/or hematocrit tests. The cap, being opaque, is easily distinguished from the red blood cells when the blood sample is analyzed.

The capillary tube 12, if to be used for quantitative buffy coat analysis, is provided as a pre-assembled device including the cap 14, a plastic float 28, and appropriate coatings within the tube. The inner wall of the uncapped end of the tube is preferably coated with an anticoagulent 30. A more central portion of the inner wall of the tube is coated with acridine orange 32, which acts as a supravital stain. The assembly 10 is constructed by flaming one end of the tube to remove sharp edges and to retain the float within the tube. The tube is then coated with the acridine orange, and subsequently with the anticoagulent. The float is installed, and the tube is then capped.

The sealing ring 24 provides two functions, one of which is to provide a seal between the cap 14 and inner wall of the capillary tube as described above. The ring also prevents the cap from moving too far into the tube unless intentionally pushed in. Since the cap may be preassembled to the tube, the assembly 10 could be subject to vibrations and other movements during storage or shipment. This could tend to cause the cap to settle further into the tube than originally placed, even though the plug 18 is in frictional engagement with the inner wall of the capillary tube. If the cap moved too far in, the vent grooves would be sealed off. As air in the tube could no longer be displaced through the vent grooves, the tube could not be filled via capillary action. In accordance with the invention, the ring 24 has a diameter which is sufficiently large that the lower surface thereof will frictionally engage the top end of the capillary tube 12, slightly deforming the ring. The frictional forces exerted by the ring against the top end of the tube are sufficient that the cap will not move further within the tube unless intentionally pushed. Since the vent grooves 20 extend beyond the lower edge of the ring, the seating of the lower edge of the ring on the end of the capillary tube will not cause them to be sealed off. The assembly 10 may accordingly be used to draw liquid via capillary action.

Once a desired volume of liquid is drawn into the capillary tube, the cap is fully inserted in the tube to close off the vent grooves. If the assembly is to be used for performing quantitative buffy coat analysis, the assembly is then subjected to centrifugation to separate the blood into red blood cells, plasma, and an expanded buffy coat between the plasma and red blood cell layers. The opaque cap 14 provides a clear interface between it and the red blood cells, while the plastic float causes the layers of platelets, nongranulocytes, and granulocytes to be greatly expanded. These layers can be observed either directly through a magnifier, or by machine.

The assembly 10 can also be filled with a liquid by inserting the capped end into a liquid sample and aspirating liquid through the vents. The cap would then be pushed into the tube to seal off the vent grooves. This procedure is less preferred than filling the capillary tube by capillary action via the uncapped end of the assembly, as described above.

An important feature of the present invention is the ability of the vent grooves 20 to remain open despite the compressive forces which are exerted by the capillary tube upon the plug 18. Since the dimensions of the cap 14 are very small, the vent grooves are necessarily small. Very little distortion of the plug would be required to close off one or both vent grooves.

A specific cap shall be described herein for the sole purpose of demonstrating the general size of a cap used for sealing a capillary tube. It will be appreciated that the dimensions of the cap will, of course, vary depending upon the size of the tube or vessel in which it is to be used. A cap used for sealing a glass capillary tube of the type used for sampling and analyzing blood may be between about two and two and one half millimeters (0.079–0.098 inches) in length. The diameter of the plug is about 1.7 millimeters (0.067–0.069 inches) while that of the enlarged head 16 is about 2.2 millimeters (0.086–0.088 inches). Each vent groove has a width of about three quarters of a millimeter (about 0.03 inches) and a maximum depth of about 0.37 millimeters (0.015 inches).

The materials from which the cap is made must be carefully chosen so that the plug is not significantly distorted upon its engagement with the inner wall of a capillary tube. It should also be hydrophobic so that air can escape through the vent grooves, but not blood which may contact the cap. The preferred material, SANTOPRENE® thermoplastic rubber, is a relatively soft grade of thermoplastic rubber having a hardness of 73 Shore A under ASTM Test method D2240 conducted at 25° C. The stress-strain curve for this material is elastomeric at ambient temperatures. The elastomeric properties of SANTOPRENE® thermoplastic rubber allow the plug to frictionally engage the inner wall of a capillary tube so that it is firmly retained by the tube without collapsing the vent grooves. SANTOPRENE® thermoplastic rubber is also a slippery material, which facilitates inserting the plug within a capillary tube without causing significant distortion. It is sufficiently slippery that coating the cap 14 with silicone oil, as described above, may not always be necessary.

Figure 6:
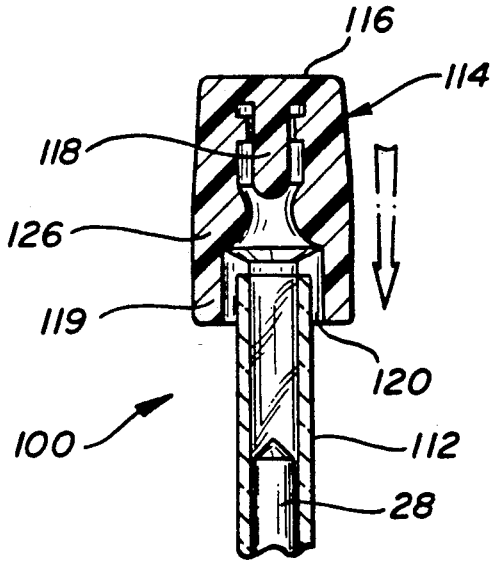
FIG. 6 is a sectional view of an alternative embodiment of a capillary tube assembly according to the invention.
Figure 7:
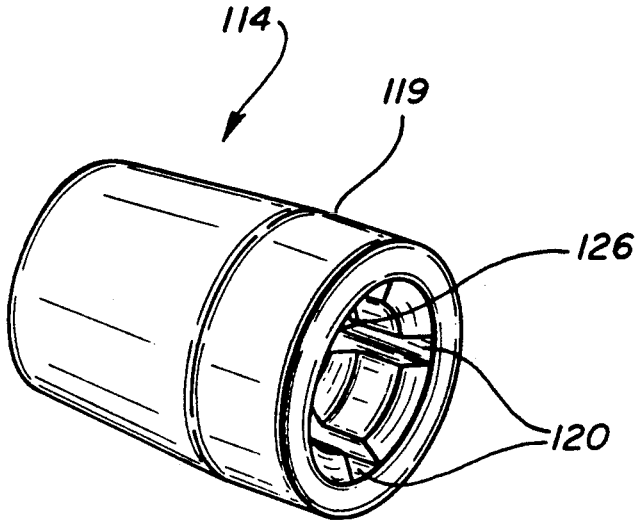
FIG. 7 is a perspective view of a cap employed in the assembly shown in FIG. 6.

An alternative embodiment of the invention is shown in FIGS. 6–7. A capillary tube/cap assembly 100 is provided which includes a cylindrical capillary tube 112 having a pair of open ends. A float 28 is positioned within the tube, while a cap 114 is mounted to one end thereof. The cap includes a top wall 116, a plug 118 extending from the center of the top wall, and a generally cylindrical, resilient skirt 119 which extends from the periphery of the top wall. The plug and skirt are substantially coaxial.

A plurality of longitudinal grooves 120 are defined within the interior surface of the skirt 119. A sealing ring 126 extends radially inwardly from this interior surface. The sealing ring is adapted to rest upon an end surface of the capillary tube when the cap is in the "venting" position. The grooves 120 extend partially through the sealing ring, thereby insuring that air can escape through the grooves when this ring is seated upon the end of the capillary tube.

The cap 114 is pushed forcefully towards the tube in order to seal one end thereof. Once this occurs, the portion of the sealing ring 126 which is above the vent grooves 120 seals the cap against the outer surface of the tube while the plug 118 provides an additional seal by engaging the inner surface of the tube. It will be appreciated that the sealing assemblies employed in the caps 14 shown in FIGS. 1 and 6 may be comprised of two parallel rings, the vent grooves extending through the lower of the two rings.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A vented cap and capillary tube assembly comprising:

a capillary tube having an axis and a pair of open ends;

an elastomeric cap having a hydrophobic external surface and slidably mounted to one of the ends of said capillary tube, said cap including an enlarged head portion and a substantially cylindrical plug extending from said enlarged head portion, said plug extending within one of the ends of said capillary tube;

means for removably positioning said cap at a predetermined first axial position with respect to the axis of said capilliary tube; and a vent groove defined within the outer surface of said plug, said vent groove being positioned on said plug such that (i) air within said capillary tube is passed through said vent groove to atmosphere when said cap is in the first axial position, and (ii) said vent groove is sealed by a surface of said capillary tube when said cap is slidably moved along the axis of said capillary tube from the first axial position to a second axial position, thereby preventing the flow of air through said vent groove.

2. An assembly as defined in claim 1 wherein said vent groove defined within the outer surface of said plug allows the passage of air, but not blood therethrough when said cap is in the first axial position.

3. An assembly as defined in claim 2 wherein said cap is comprised of a thermoplastic, hydrophobic material.

4. An assembly as defined in claim 2 wherein said plug includes an annular groove adjoining said enlarged head portion.

5. An assembly as defined in claim 4 wherein said vent groove extends substantially parallel to a longitudinal axis of said plug.

6. An assembly as defined in claim 4 wherein said plug includes an annular ring projecting radially therefrom.

7. An assembly as defined in claim 6 wherein said vent groove extends between an end of said plug and a point between said end and said enlarged head portion.

8. An assembly as defined in claim 7 including a plurality of vent grooves defined within an outer surface of said plug.

9. An assembly as defined in claim 6 wherein said vent groove extends at least partially through said annular ring such that air escapes through said vent groove when said cap is in the first axial position and said positioning means includes a lower surface of said annular ring that engages an end of the capillary tube when said cap is in the first axial position.

10. An assembly as defined in claim 9 wherein said vent groove extends substantially parallel to a longitudinal axis of said plug and partially within said annular ring.

11. An assembly as defined in claim 1 wherein said plug has a diameter of less than two millimeters, and said capillary tube includes a float positioned therein.

12. A vented cap and capillary tube assembly comprising:

a capillary tube having a pair of open ends; and a cap slidably mounted to one of the ends of said capillary tube, said cap including a vent groove for establishing fluid communication between the interior of said capillary tube and atmosphere, said cap further including an integral ring with a bottom surface for engaging a wall at one of the ends of said capillary tube, said vent groove extending at least partially within said ring such that said vent groove (i) remains open when the bottom surface of said ring engages the wall of said capillary tube, and (ii) closes when said cap is fully engaged with said capillary tube.

13. An assembly as described in claim 12 wherein said cap is elastomeric and includes a slippery exterior surface.

14. An assembly as described in claim 12 wherein said cap includes an enlarged head portion and a substantially cylindrical plug extending from said head portion, said ring extending radially from said cylindrical plug.

15. An assembly as described in claim 12 wherein said cap includes a top wall and a generally cylindrical, resilient skirt extending from said top wall, said skirt extending over a portion of said capillary tube, said vent groove being defined within an interior surface of said skirt, said ring extending radially inwardly from said interior surface of said skirt.

* * * * *